United States Patent [19]

Smith

[11] 3,998,232

[45] Dec. 21, 1976

[54] FILTERING TOBACCO SMOKE

[76] Inventor: Avery B. Smith, 36 Surrey Drive, Wallingford, Conn. 06492

[22] Filed: Oct. 31, 1974

[21] Appl. No.: 519,528

[52] U.S. Cl. ..... 131/262 B

[51] Int. Cl.[2] ..... A24B 15/02

[58] Field of Search ..... 131/262 R, 262 B, 265, 131/10.7 X, 225

[56] References Cited

UNITED STATES PATENTS

| | | | |
|---|---|---|---|
| 3,028,864 | 4/1962 | Minto | 131/262 B X |
| 3,087,500 | 4/1963 | Jacobson | 131/10.7 X |
| 3,217,715 | 11/1965 | Berger et al. | 131/262 R X |
| 3,251,365 | 5/1966 | Keith et al. | 131/265 X |
| 3,757,803 | 9/1973 | Chiang | 131/262 B |

FOREIGN PATENTS OR APPLICATIONS

| | | | |
|---|---|---|---|
| 647,622 | 8/1964 | Belgium | 131/262 B |

*Primary Examiner*—Robert W. Michell
*Assistant Examiner*—V. Millin
*Attorney, Agent, or Firm*—St.Onge Mayers Steward & Reens

[57] ABSTRACT

A tobacco smoke filter cartridge comprises essentially a wrapper of an electrically insulating material, a bed of particles of an electrically conductive or semi-conductive material packed into the filter chamber defined by the wrapper, and two spaced electrodes in electrical contact with the bed of particles for passing an electric current therethrough. The cartridge may be mounted in a cigarette or cigar holder or the stem of a pipe with a miniaturized electric supply circuit built into the holder.

7 Claims, 1 Drawing Figure

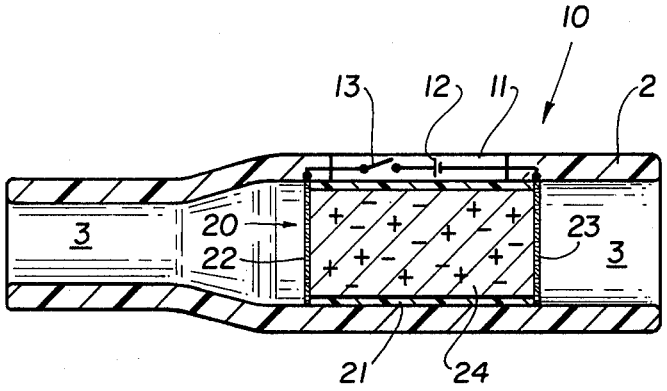
10
13
12
11
2
3
20
22
23
3
21
24

FILTERING TOBACCO SMOKE

The present invention relates to improvements in filtering tobacco smoke, and more particularly to a tobacco smoke filter cartridge for use in cigarette or cigar holders and in pipes, as well as a method for filtering tobacco smoke with such filter cartridges.

As is known, tobacco smoke consists of a gaseous or vapor phase in which are suspended liquid or semi-liquid droplets or solid particles which form a visible smoke stream. Various and generally small quantities of toxic or noxious materials, such as the acidic gaseous compounds hydrogen cyanide and hydrogen sulfide, as well as others, are present in the smoke stream and filters of varying efficiency have been proposed to remove at least a proportion of such substances from the tobacco smoke.

A very effective tobacco smoke filter material has been disclosed in U.S. Pat. No. 3,251,365. This filter material consists essentially of non-toxic activated charcoal granules having a specific surface area exceeding a million square centimeters per gram, a particle size between 8 to 50 mesh, and impregnated with about 1% to 13%, preferably 4% to 6%, by weight thereof, of iron or zinc oxides, plus at least 1% of the other (non-selected) oxide, the oxide being in finely divided form and present in an amount not exceeding about 14% of the weight of the charcoal granules.

Activated charcoal of gas adsorbent grade has a specific surface area in excess of 5 million square centimeters per gram and may be manufactured from bituminous coal. The particles are of such size that they will pass through a U.S. Series No. 8 sieve because larger particles are difficult to handle and to incorporate into a tobacco smoke filter cartridge but they should not pass through a U.S. Series number 50 sieve because particles smaller than that adversely affect the draw resistance of the filter.

This type of tobacco smoke filter material, its method of manufacture and its effectiveness is described in U.S. Pat. No. 3,251,365.

Filtering of tobacco smoke by passing the smoke through electric fields has been proposed in various filtering devices disclosed in U.S. Pat. Nos. 3,028,864 3,070,100 and 3,757,803. In general, they provide spaced electrode means establishing therebetween an electric field through which the tobacco smoke passes.

It is the primary object of this invention to improve the filtering of tobacco smoke, particularly by synergistally combining adsorbency with the electrochemical treatment of the noxious components of the smoke.

This and other objects are accomplished in accordance with the invention by a tobacco smoke filter cartridge comprised essentially of a wrapper of electrically insulating material which defines a filter chamber, a bed of particles of electrically conductive or semi-conductive material packed into the filter chamber, and at least two spaced electrodes in electrical contact with the bed of particles. When a source of D.C. current is connected to the electrodes to form an anode and a cathode, an electrical path of relatively low conductivity will be established through the bed and a phenomenon known as bipolarity is produced in the individual conductive or semi-conductive particles. In other words, each particle will develop a negative and a positive pole, thus providing a multitude of positive and negative sites within the filter chamber where electrochemical reactions, i.e. reduction and oxidation, will take place, rather than merely at the electrodes, as in conventional electrolytic cells or prior art electrical field filters.

When the tobacco smoke, which is generally at least somewhat moist, is introduced and passed through the filter cartridge through a suitable inlet and outlet at the respective ends of the cartridge, an electrochemical reaction occurs at each electrically charged site whereby positively charged ions are reduced and deposited on or at the negatively charged sites of the filter bed particles. Oxidizable ions are oxidized at the positively charged sites. Selection of suitably adsorbent materials for the particles of the filter bed will make it possible to retain the products of the electrochemical reaction as well as any organic contaminants in the smoke.

The preferred particle material is the impregnated activated charcoal described hereinabove but other carbonaceous materials, such as graphite, non-impregnated charcoal, bone char and carbon black, may also be used. While these carbonaceous particulate materials provide adsorption as well as electrochemical reaction sites, electrolytic reactions alone may be obtained with metallic or other conductive or semi-conductive particles devoid of adsorptive properties. The particle size is not critical for obtaining the desired electrochemical reactions and will be selected according to the general practice of particulate tobacco smoke filters in an effort to obtain easy draw. Any suitable electric current conductive metallic or carbonaceous material may be used for the electrodes, graphite or aluminum being useful materials, by way of example.

The above and other objects, advantages and features of the present invention will become more apparent from the following detailed description of a now preferred embodiment thereof, taken in conjunction with the single FIGURE of the accompanying drawing showing a cigarette or cigar holder with a filter cartridge inserted therein in longitudinal, axial cross section.

Clearly, the holder may take any desired and suitable form to accommodate any smoking article, such as cigarettes, cigars or the like. It may also constitute the mouth piece or stem of a pipe. As is usual, holder 10 is of electrically insulating material, such as a synthetic resin, wood or the like. It usually has a narrowed mouth piece 1 at one end and an opposite end 2 designed for insertion of a cigarette or cigar, for instance, or attachment to the stem of a pipe. The holder is generally tubular and defines axial bore 3 permitting tobacco smoke to pass therethrough from the smoking article to the mouth piece.

Tubular tobacco smoke filter cartridge 20 is removably arranged in bore 3 of the holder, the outer diameter of the cartridge being substantially the same as the inner diameter of the bore so that the cartridge forms a friction fit with the holder but may be removed therefrom by manually pushing the cartridge out of end 2 of the holder or by providing a suitable ejection means in the holder wall.

The illustrated cartridge is comprised of paper or synthetic resin wrapper 21 which may be constituted by a simple open-ended tube, the ends of the tubular wrapper providing the inlet and outlet for the passage of tobacco smoke from holder end 2 to mouth piece 1. In the illustrated embodiment, porous or perforated electrodes 22 and 23 are mounted on tubular wrapper 21 across the inlet and outlet ends thereof, thus defining a filter chamber with the wrapper. The porosity or perforation of the electrode plates must be sufficient to permit an easy draw of the tobacco smoke therethrough but fine enough to prevent the particulate filter material from leaking from the filter bed. If desired cotton or like plugs may be placed between the filter bed and the electrodes, in which case the electrodes may have conductive projections passing through the plugs to make electrical contact with the filter bed particles. Also, electrically nonconductive closure plates may be placed across the filter chamber inlet and outlet, and the spaced electrodes may be otherwise arranged in the cartridge, for instance at opposite portions of the cartridge wrapper, or in any other suitable manner permitting a flow of current between the spaced electrodes through the filter chamber.

The filter chamber essentially defined by the electrically insulating wrapper 21 of cartridge 20 is packed with particles of an electrically conductive or semi-conductive material, electrodes 22 and 23 being in electrical contact with bed 24 of conductive particles. The size of the particles is not critical and will be chosen primarily to assure that the filter provides a relatively unimpaired draw for the smoker. Thus, while a particle size of about 8 to 50 mesh may be preferred for most purposes, the size could vary between several hundred microns, or less, to about one or two millimeters, or more. Also, as pointed out hereinabove, while any conductive or semi-conductive material may be used and carbonaceous materials will probably be most useful, activated carbon or charcoal is preferred and the impregnated activated charcoal described in U.S. Pat. No. 3,251,365 is presently the most preferred material for the particles of bed 24, other suitable adsorbent or absorbent materials which are electrically conductive or semi-conductive will occur to those skilled in the art as useful particle materials.

Holder 10 for the smoking article, which may be a cigarette, cigar or pipe, defines chamber 11 housing a miniaturized electrical power supply and supply circuit for electrodes 22 and 23. This power supply and supply circuit comprises D.C. source 12, such as a miniature battery, and electrical conductors leading from the electrical power source to the electrodes, the conductors having leads supplying direct current to electrodes 22 and 23, one of the electrodes operating as an anode and the other electrode as a cathode when connected to the power source. Switch 13, which may be a slip or slide switch, may be actuated by the smoker to connect power source 12 to electrodes 22, 23 so as to produce a current flow between the electrodes. The applied voltage may be up to about 4.5 volts, preferably in the range of 1.35 to 1.50 V, but the voltage is not critical. With smaller particle sizes, the air gap between filter particles becomes smaller and lower voltages may be used. Conversely, higher voltages will be preferred with larger filter particles defining larger air gaps and a correspondingly greater resistance therebetween. The current flow through conductive or semi-conductive bed 24 will set up a positive and a negative charge on the multitude of particles in the bed. The type of miniaturized electric supply circuit useful herein is found in electric wristwatches, for instance.

In a conventional electrolytic cell, when direct current is applied to spaced electrodes immersed in an electrolyte, the electrical circuit of the treatment system is completed solely through ionization of the solution in the cell and migration of the ions to the surfaces of the two electrodes. Thus, all the current in a conventional electrolytic cell is carried through the solution by ion migration. At the surfaces of the anode and cathode, respectively oxidation and reduction reactions occur. The electrodes thus act as catalytic surfaces on which the electrochemical reaction takes place, this reaction being strictly localized at the electrode surfaces.

In the present system, on the other hand, a phenomenon known as bipolarity in the individual particles of bed 24 occurs, thus producing, in effect, a multitude of reaction sites, each particle having a positive and a negative site on which reduction and oxidation may occur and where the reaction products are adsorbed or absorbed. This general phenomenon of a cell comprised of a conductive particle bed in electrical contact with spaced electrodes has been described in my copending U.S. application Ser. No. 764,255, filed Oct. 1, 1968, whose teaching is incorporated herein by reference.

The provision of the multitude of electrochemical reaction sites in the tobacco smoke filter of the present invention, particularly when combined with increased adsorbency of the filter bed particles, substantially increases the effectiveness of the filter in reducing the content of noxious materials in the tobacco smoke while leaving the drawing quality unimpaired.

While the invention is clearly not limited thereby, following are some examples illustrating the practice of this invention. In all examples, a commercially available small cigarette holder of conventional structure was used. The tubular wrapper 21 was formed of plastic cylinders, such as regenerated cellulose sheets, having an approximate length of 20mm and a diameter of about 8 mm. Each end was capped with perforated aluminum foil to form electrodes 22 and 23. Prior to closing the second end of the tubular wrapper, the particulate material of the following examples was packed into the tube to form filter bed 24. Wires were attached to the two aluminum foil electrodes and connected to the opposite poles of a battery. In all instances, a number of smokers sampled the same cigarette smoked without the electric current switched on and then with the current passed through the filter, discovering an amazing improvement in the quality and taste of the smoke.

EXAMPLE 1

The filter bed was formed by activated carbon particles having an average size distribution of about 0.01 to 0.5 mm. A potential of 1.35 volts was applied to the filter bed.

EXAMPLE 2

Charcoal normally used in barbecue grills was pulverized to a small particle size of less than 0.2 mm, the same voltage being applied as in Example 1.

EXAMPLE 3

A filter cartridge claimed to be made under U.S. Pat. No. 3,251,365 was removed from a commercially available cigarette and inserted in the holder in place of the tubular filters used in Examples 1 and 2. The paper ends of these commercially available filters were replaced by aluminum foil electrodes and a potential of 1.5 volts was applied.

While the present invention has been described hereinabove in connection with certain now preferred embodiments, it will be clearly understood that many variations and modifications may occur to those skilled in the art, particularly after benefitting from this teaching, without departing from the spirit and scope of this invention as defined in the appended claims.

What is claimed is:

1. In an apparatus for filtering tobacco smoke, and having a source of electrical power; a tobacco smoke filter cartridge comprising:

a wrapper of an electrically insulating material, the wrapper defining a filter chamber, a bed of particles of material packed into the filter chamber, the material having conductivity at least equal to the conductivity of a semiconductor, and two spaced electrodes, in electrical contact with the bed of particles, mounted for connection to the power source.

2. The tobacco smoke filter cartridge of claim 1, wherein the material is an adsorptive material.

3. The tobacco smoke filter cartridge of claim 2, wherein the adsorptive material is carbonaceous.

4. The tobacco smoke filter cartridge of claim 3, wherein the carbonaceous material is activated carbon.

5. The tobacco smoke filter cartridge of claim 4, wherein the material consists essentially of non-toxic activated charcoal granules having a specific surface area exceeding a million square centimeters per gram, a particle size between 8 to 50 mesh, and impregnated with about 1% to 13%, by weight thereof, of iron or zinc oxides, plus at least 1% of the other (non-selected) oxide, the oxide being in finely divided form and present in an amount not exceeding about 14% of the weight of the charcoal granules.

6. An apparatus for filtering tobacco smoke comprising:

A. a tobacco smoke filter cartridge including 1. a wrapper of an electrically insulating material, the wrapper defining a filter chamber,
2. a bed of particles of material packed into the filter chamber, the material having conductivity at least equal to the conductivity of a semiconductor, and
3. two spaced electrodes in electrical contact with the bed of particles, and B. a holder of an electrically insulating material for a smoking article, the holder defining a cartridge chamber for receiving the cartridge, including 1. a miniaturized direct current source arranged in the cartridge chamber of the holder,
2. a supply circuit for supplying direct current from the source to the electrodes, and
3. a switch in the supply circuit.

7. A method of filtering tobacco smoke, comprising the steps of connecting a source of direct current to two spaced electrodes which are in electrical contact with a bed of adsorbent or absorbent particles of material having conductivity at least equal to the conductivity of a semiconductor in order to cause each of the particles to have a site of negative polarity and a site of positive polarity, and passing the smoke through the packed bed of particles whereby noxious materials in the smoke are subjected to electrochemical reactions at said sites and the reaction products are absorbed or adsorbed.

* * * * *